US006173548B1

(12) United States Patent
Hamar et al.

(10) Patent No.: US 6,173,548 B1
(45) Date of Patent: Jan. 16, 2001

(54) PORTABLE MULTI-SECTION ACTIVITY FLOOR AND METHOD OF MANUFACTURE AND INSTALLATION

(76) Inventors: Douglas J. Hamar, 220 Willson Memorial Dr.; Mark S Young, P.O. Box 318, both of Chassell, MI (US) 49916

( * ) Notice: Under 35 U.S.C. 154(b), the term of this patent shall be extended for 0 days.

(21) Appl. No.: 09/081,799

(22) Filed: May 20, 1998

Related U.S. Application Data

(60) Provisional application No. 60/047,204, filed on May 20, 1997.

(51) Int. Cl.[7] ..... E04B 1/00

(52) U.S. Cl. ..... 52/582.1; 52/592.1; 52/480; 52/403.1

(58) Field of Search ..... 52/582.1, 592.1, 52/480, 489.1, 391, 403.1, 586.1

(56) References Cited

U.S. PATENT DOCUMENTS

| | | | | |
|---|---|---|---|---|
| 1,968,714 | * | 7/1934 | Schuck | 52/391 |
| 2,027,292 | * | 1/1936 | Rockwell | 52/391 X |
| 2,914,815 | * | 12/1959 | Alexander | 52/592.1 |
| 3,619,964 | * | 11/1971 | Passaro et al. | 52/391 X |
| 4,538,392 | * | 9/1985 | Hamar et al. | 403/336 X |
| 4,910,936 | * | 3/1990 | Abendroth et al. | 52/480 X |
| 5,109,898 | * | 5/1992 | Schacht | 52/592.1 X |
| 5,157,890 | * | 10/1992 | Jines | 52/582.1 |
| 5,412,917 | * | 5/1995 | Shelton | 52/480 X |
| 5,465,546 | * | 11/1995 | Buse | 52/480 |
| 5,647,183 | * | 7/1997 | Counihan | 52/480 X |
| 5,887,331 | * | 3/1999 | Little | 52/480 X |

FOREIGN PATENT DOCUMENTS

| | | | | |
|---|---|---|---|---|
| 970083 | * | 12/1950 | (FR) | 52/592.1 |

* cited by examiner

*Primary Examiner*—Beth A. Stephan
*Assistant Examiner*—Brian E. Glessner

(57) ABSTRACT

A floor for a basketball court or the like assembled from a plurality of separate floor sections arranged in staggered rows with each section including a plurality of spaced apart sleepers, a subfloor secured to the sleepers, and a wood strip flooring layer secured to the subfloor. Abutting edges of adjoining floor sections are reinforced by tongues and complementary edge pockets mounted on respective abutting edges of adjoining sections. The edge pockets may be formed by recessing the subfloor inwardly of outer edges of the sleepers and the flooring layer. A similar edge pocket may be formed on the adjoining floor section that the tongue is received into. Each tongue is preferably fabricated of a tough, non-marring polymeric material such as ultra-high molecular weight plastic. Alternatively, a similar tongue and pocket arrangement may be formed by mounting a tongue and bracket set on the subfloors of adjoining floor sections.

27 Claims, 4 Drawing Sheets

12
50
52
18
34
33
38
14a
24
26
29
14a
29
30
33
28
32
22
38'
30
14b
29
30
29
33
38'
16
16
34
30
14b
29
29
30
40'
44
30
14b
29
29
46
28
46
46
46
29
29
30
14a
30
26
44
40
24
38
33
18
50
52

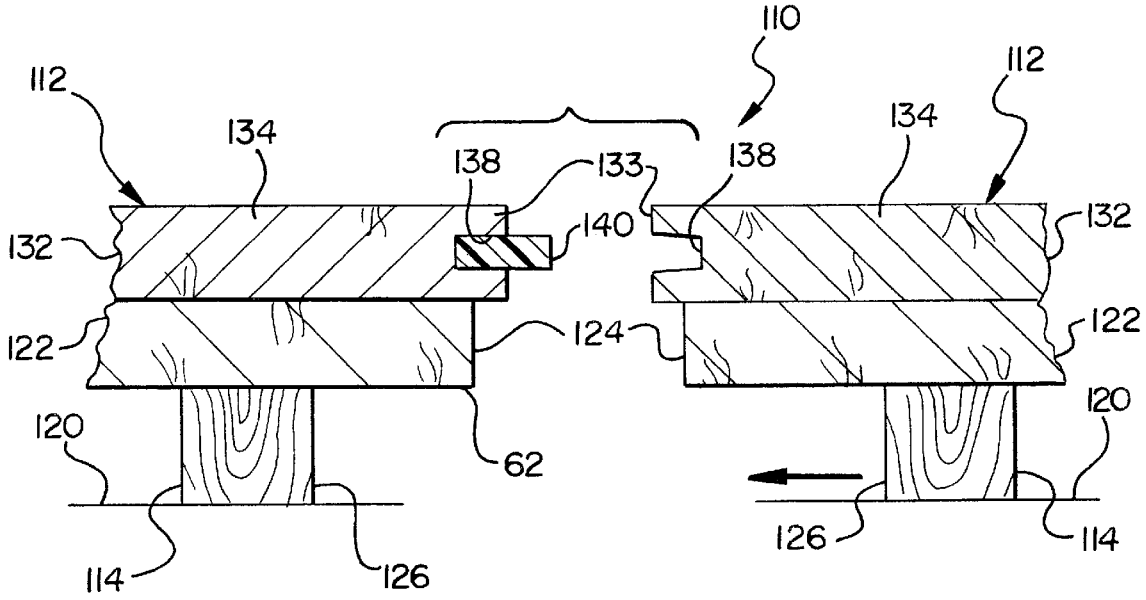
FIG-7
FIG-8
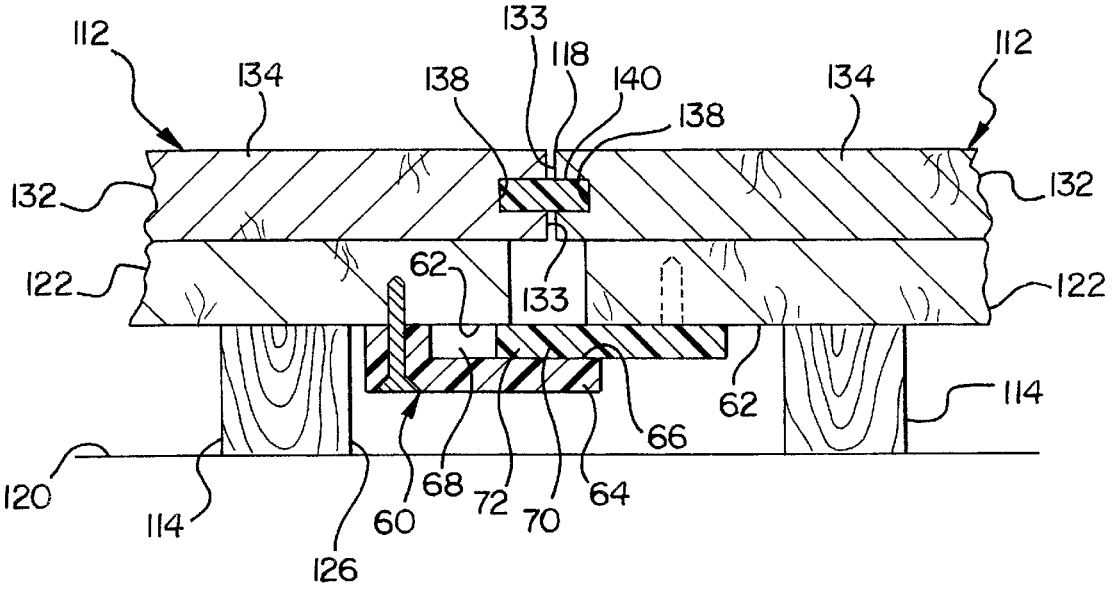

PORTABLE MULTI-SECTION ACTIVITY FLOOR AND METHOD OF MANUFACTURE AND INSTALLATION

This application is based on and claims priority in U.S. Provisional patent application Ser. No. 60/047,204 filed May 20, 1997.

This invention relates generally to portable, multi-section activity floors such as those used for basketball and volleyball games, dancing, and other activities compatible with such flooring, and more particularly to the means and methods of interconnecting the individual floor sections along their edge joints to provide a continuous, stable playing surface.

BACKGROUND OF THE INVENTION

Specially designed wood strip flooring is often permanently installed in some sporting facilities that are dedicated to hosting basketball games, volleyball games, dancing events, and other activities that are compatible with the wood strip playing surface. Wood strip flooring is durable, sound, and inherently resilient. These characteristics enable the floor to absorb some of the shock of a participant's weight and in the case of basketball, the pounding of the ball, giving the floor a natural, lively feel that is unique to wood flooring and preferred by many athletics.

There are, however, a growing number of facilities that are designed to host a multitude of different activities that call for different flooring requirements. Although the above described permanent wood flooring system would be suitable for some events such as basketball games, it would not be suitable for many other events including figure skating, hockey games, concerts, auto shows, etc. Such facilities rely instead on temporary flooring systems that are suited for the particular type of event being hosted and which can be laid down and taken up fairly quickly and easily.

Temporary basketball flooring systems present a particular challenge since not only must they be designed for quick installation and removal, they must still meet the rigorous playability standards of a permanent wood strip flooring. When installed, temporary basketball flooring must exhibit the same soundness, firmness and resilience characteristics favored in permanent wood strip floors.

A typical temporary basketball flooring system is made up of a plurality of individual floor sections that interconnect with one another to provide a continuous playing surface like that of a permanent floor. One such temporary wood strip flooring system is disclosed in U.S. Pat. No. 4,538,392, which is commonly assigned to the assignee of the present invention. Its floor sections are installed in staggered rows. Each floor section is constructed from a plurality of sleepers, a subfloor secured to the sleepers, and a wood strip flooring layer secured to the subfloor. The adjoining ends of adjacent sections have extended intermeshing finger portions of the wood strip flooring that laterally restrain the sections in each row. Suitable connecting hardware secures the sections in each row to those in an adjacent row.

It is important also that the floor sections not flex downwardly or upwardly at the joints, as such would detract from presenting a sound, uniform playing surface particularly at the joint regions. The flooring system disclosed in the aforementioned patent uses the traditional tongue-and-groove wood strip flooring material for the top playing surface. The tongue-and-groove formations are exposed along the outer edges of the side-most strips, and as well as along the sides of the fingers. When the sections are brought together, the tongue-and-groove formations interlock and act to support the wood strip flooring layer against such flexing at the joints.

One additional consideration in designing temporary sectionalized wood flooring systems of the above type is to construct them to be rugged so that they can withstand repeated installation and removal without sustaining damage. Should the exposed finger or tongue portions of a section become damaged, it may require repair. Although the flooring system disclosed in the aforementioned patent has shown to be highly durable, the present invention provides further improvements in durability and ease of assembly.

Another known sectionalized flooring system employs the same basic three layer floor section structure, but omits the finger joints at the ends of the sections and the traditional tongue-and-groove formations along the sides. The subfloor layer is extended beyond the marginal edges of the wood strip flooring layer and as well beyond the underlying sleepers along two sides of each section to serve as a tongue. The projecting tongue portion of the subfloor is covered by a metal cap. Along the remaining two sides of the section, the wood strip flooring is extended beyond the subfloor and sleepers to provide an overhang region. A length of metal C-channel is anchored to the underside of the overhung flooring layer and to the subfloor layer to provide an open channel or groove along the remaining two sides. There is nothing below the channel that supports it. The sleepers are set inwardly in line with or inward of the subfloor. When the sections are brought together, the metal-capped tongue of one floor section slides into the metal C-channel of an adjacent floor section to provide support to the sections at the joint. Such metal cap and channel members add to the cost and complexity of manufacturing sectionalized floor systems and introduce an element, namely the metal C-channel, that is susceptible to bending.

A flooring system constructed in accordance with the present invention overcomes or greatly minimizes the foregoing objections to the prior flooring systems discussed above.

SUMMARY OF THE INVENTION AND ADVANTAGES

A portable multi-section activity floor constructed in accordance with the invention comprises a plurality of floor sections adapted to be assembled to one another on a generally planar base surface along abutting end and side edges thereof to provide a continuous playing surface. Each floor section has a plurality of spaced apart sleepers engagable with the base surface, a subfloor secured to the sleepers, and a flooring layer secured to the subfloor. A pocket is formed along at least one abutting edge of adjacent floor sections between the flooring layer and the sleepers and is defined by a recessed edge of the subfloor spaced inwardly of an outer edge of the flooring layer and at least one underlying sleeper, exposing an underside surface of the flooring layer and an upper surface portion of the underlying sleeper or sleepers. A tongue member is provided on the adjacent section along its mating edge between the flooring layer and at least one underlying sleeper in position to be received in the pocket of the other section when the floor sections are assembled to support the sections across the edge joint from moving relative to one another out of their common plane.

According to particular preferred features, the tongue is fabricated of a strip of polymeric material, and preferably ultra-high molecular weight plastic (sometimes referred to as UHMW), which is durable, nonmarring, and is able to be nailed through for purposes of securing the tongue to its supporting floor section.

According to a still further feature, such an edge pocket is provided along the mating edges of both of the adjacent panels. The tongue is mounted in the pocket of one of the sections and projects therefrom beyond that floor section and is received and removably supported within the pocket of the adjacent floor section when the panels are assembled.

According to a particular method of the invention, the edge pockets are formed by recessing the subfloor along the mating edge inwardly of the outer edge of the overlying flooring layer and underlying sleeper or sleepers, exposing underside and topside surfaces of each. The tongue member is installed in one of the edge pockets and is secured in place preferably by nails or fasteners.

According to a preferred method of assembly, the sections are brought together along their mating edges causing the projecting portion of the tongue to extend into the opposing edge pocket of the adjacent floor section. The upper surface of the tongue directly contacts and thus supports the flooring layers of the adjacent sections, and the bottom surface of the tongue rests upon and is supported by the sleepers adjacent the mating edges of the sections. The full surface to surface contact between the tongue and the wood strip flooring and sleeper members of the floor sections maintains the sections in precise alignment and prevents any flexing or shifting of the sections upwardly or downwardly out of their plane.

The invention has the further advantage of integrating the edge pockets into the construction of the floor sections by simply recessing the subfloor layer along the edge, thereby eliminating the need for metal brackets or the like susceptible to bending, marring or breakage.

According to another embodiment of the invention, a portable multi-section activity floor is provided having a plurality of floor sections adapted to be assembled to one another along mating end and side edges thereof to provide a continuous playing surface. Each flooring section likewise has a plurality of sleepers, a subfloor layer applied to the sleepers, and a flooring layer applied to the subfloor. At least one edge pocket is provided along at least one edge of a floor section and at least one tongue is supported on an adjacent floor section in position to be received within the pocket of the mating floor section when the sections are assembled. The tongue is fabricated of polymeric material, and preferably, ultra-high molecular weight plastic.

According to a particular embodiment of this aspect of the invention, an edge pocket is formed in the flooring layer along the mating edge and the tongue is supported by the flooring layer of the adjacent panel and is received into the edge pocket when the sections are assembled.

According to a further feature of this aspect of the invention, an additional edge pocket may be provided by a generally L-shaped bracket mounted on a bottom surface of the subfloor. A second tongue is mounted flush to the bottom surface of the adjacent floor section and is received in the pocket formed between the L-shaped bracket and the bottom surface of the subfloor when the sections are assembled.

According to a further aspect of the invention, the L-shaped bracket and its associated tongue are likewise fabricated of polymeric material, and preferably ultra-high molecular weight plastic.

At least one embodiment of the invention has the further advantage of enabling the above described edge support systems to be utilized along both the end and side edges of the floor sections. When used along an end-to-end joint, the ends of the floor sections may be squared, thereby eliminating any breakage concerns associated with intermeshing finger joints.

These and other objects, features and advantages will become more apparent from the following detailed description when considered in connection with the accompanying drawings, wherein:

BRIEF DESCRIPTION OF THE DRAWINGS

FIG. 7 is an enlarged, fragmentary cross-sectional views of adjacent panel sections having edge connection features constructed in accordance with a second embodiment of the invention and shown in the disassembled and assembled condition, respectively.

FIG. 8 is an enlarged, fragmentary cross-sectional views of adjacent panel sections having edge connection features constructed in accordance with another embodiment of the invention and shown in the disassembled and assembled condition, respectively.

DETAILED DESCRIPTION

Figure 1:
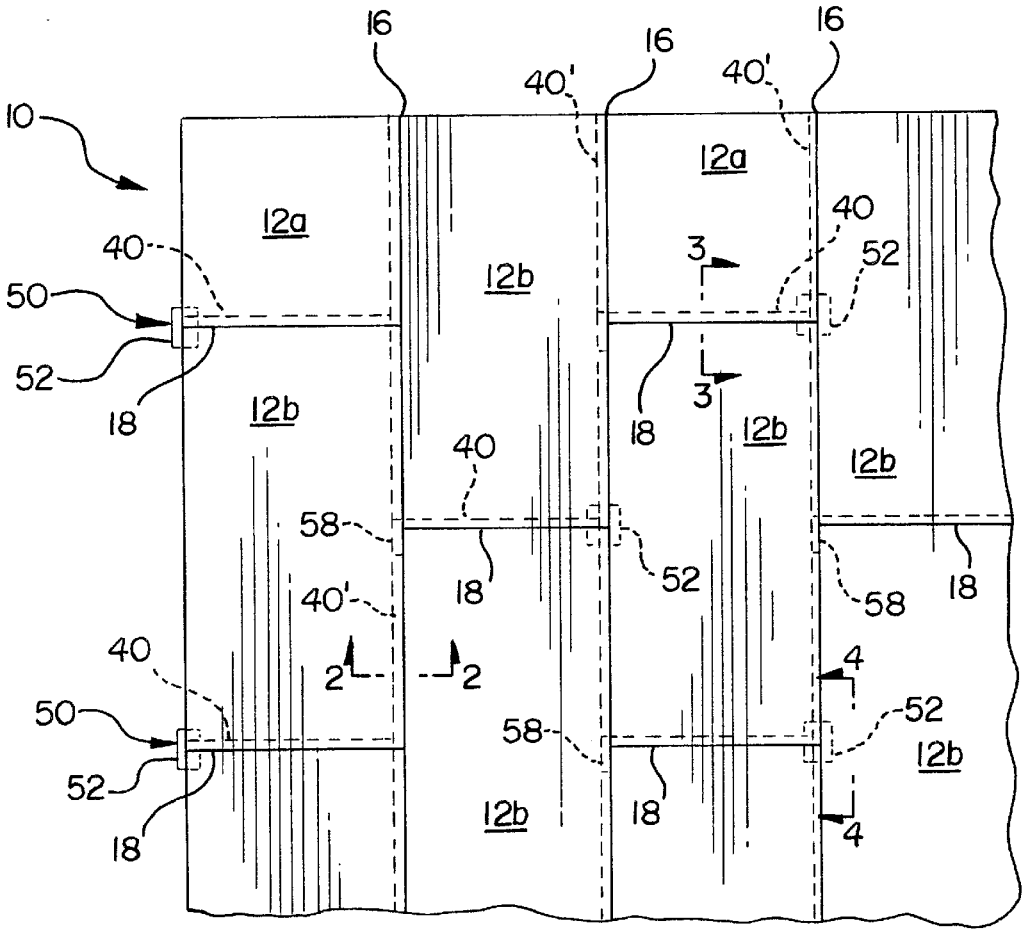
FIG. 1 is a fragmentary top plan view of a portable multi-section activity floor constructed in accordance with a first embodiment of the invention.

FIG. 1 illustrates a top plan view of a fully assembled portable multi-section activity flooring system, generally referenced at 10, constructed and assembled in accordance with one presently preferred embodiment of the invention. The assembled flooring system 10 provides a planar activity surface particularly suited as a basketball court or for other activities compatible with such flooring, including volleyball games, dancing, etc.

As will be described in greater detail below, the flooring system 10 is made up of a plurality of separate floor panels or sections 12 assembled in longitudinally aligned, alternately staggered rows that together define a continuous activity flooring area. As shown in FIG. 1, the floor sections 12 are generally rectangular in shape and, according to convention, are constructed to be four feet in width and with some of the outer most perimeter or boundary sections measuring four feet in length, with the remaining boundary sections and the interior floor sections measuring eight feet in length, respectively, indicated at 12*a* and 12*b* in FIG. 1. Of course, the relative dimensions are not critical and could be larger or smaller in length and width. The staggered joint relationship is advantageous in promoting strength for the overall assembled flooring system by avoiding the presence of a joint which would otherwise extend transversely across the entire width of the flooring area.

Apart from the floor sections that lie along the boundary of the flooring system 10, the floor sections 12 are preferably identical in construction. That is, the interior four by eight sections 12*b* are repetitive units that, apart from any playing surface markings, are fully interchangeable with one another. Many of the boundary sections are also identical in construction to one another, although their outer edges are not adapted to intermesh with adjacent floor sections.

As best shown in FIGS. 2–6, each floor section 12 is constructed from a plurality of spaced apart stringers or sleepers 14. The sleepers 14 extend across the width of the floor sections 12 between opposite side edges 16 thereof and are arranged such that a pair of end-most stringers 14*a* are disposed adjacent longitudinal end edges 18 of the sections, and at least one and preferably a plurality of intermediate stringers 14*b* are provided at spaced intervals along the length of the floor section 12 in spaced relation to the end-most stringers 14*a*.

The sleepers 14 are preferably rectangular in cross-section, with the end-most stringers 14*a* having a width preferably greater than the width of the intermediate stringers 14*b* for reasons to be discussed below. The stringers 14 serve as the feet or contact with a base surface 20 on which the flooring system is to be assembled. The base surface 20 may comprise a concrete floor, an insulated ice surface, or other suitable, substantially horizontal planer support surface.

An underlayment or subfloor 22 of oriented strand board, plywood, or other sheet of suitable structural material is secured to the sleepers 14 by nails, screws, adhesives, or an equivalent suitable means. As may be appreciated best from the top plan view illustration of FIG. 6, the subfloor 22 of an interior floor section 12 is dimensioned such that at least one and preferably all of its marginal edges are recessed or set in from the outer end and side edges of the underlying sleepers 14.

Typically, at least one and preferably both end edges 24 of the subfloor are set back from adjacent outer side edges 26 of the end-most sleepers 14*a*, and/or at least one and preferably both of the marginal side edges 28 of the subfloor 22 are set in or recessed from the longitudinal end faces 29 of the sleepers 14. Such insetting of the subfloor 22 exposes a top surface portion 30 of the sleepers 14 along one or more of the edges 16, 18 of the floor section that are adapted to assembled with corresponding edges of adjacent panels.

It will be appreciated that the subfloor 22 of the boundary floor sections need only be recessed along only those edges that mate with adjacent floor sections. That is, the subfloor outboard side edges or end edges that define the perimeter of the floor need not be recessed.

A flooring layer 32 is secured to the subfloor 22 in any conventional manner such as by nails, screws, adhesives or the like. The flooring layer 32 is preferably of the usual type comprising flat, interlocking tongue-and-groove flooring strips 34 of northern maple or other suitable hardwood extending preferably lengthwise of the floor sections 12 transverse to the direction of the sleepers 14. While longitudinal wood strip flooring is the preferred flooring surface, it will be appreciated that other flooring materials may be used including parquet wood flooring and other geometric designs fabricated of interjoined wood strips. Of course, other suitable non-wood flooring surfaces for any intended usage may also be employed, within the scope of the present invention.

Figure 6:
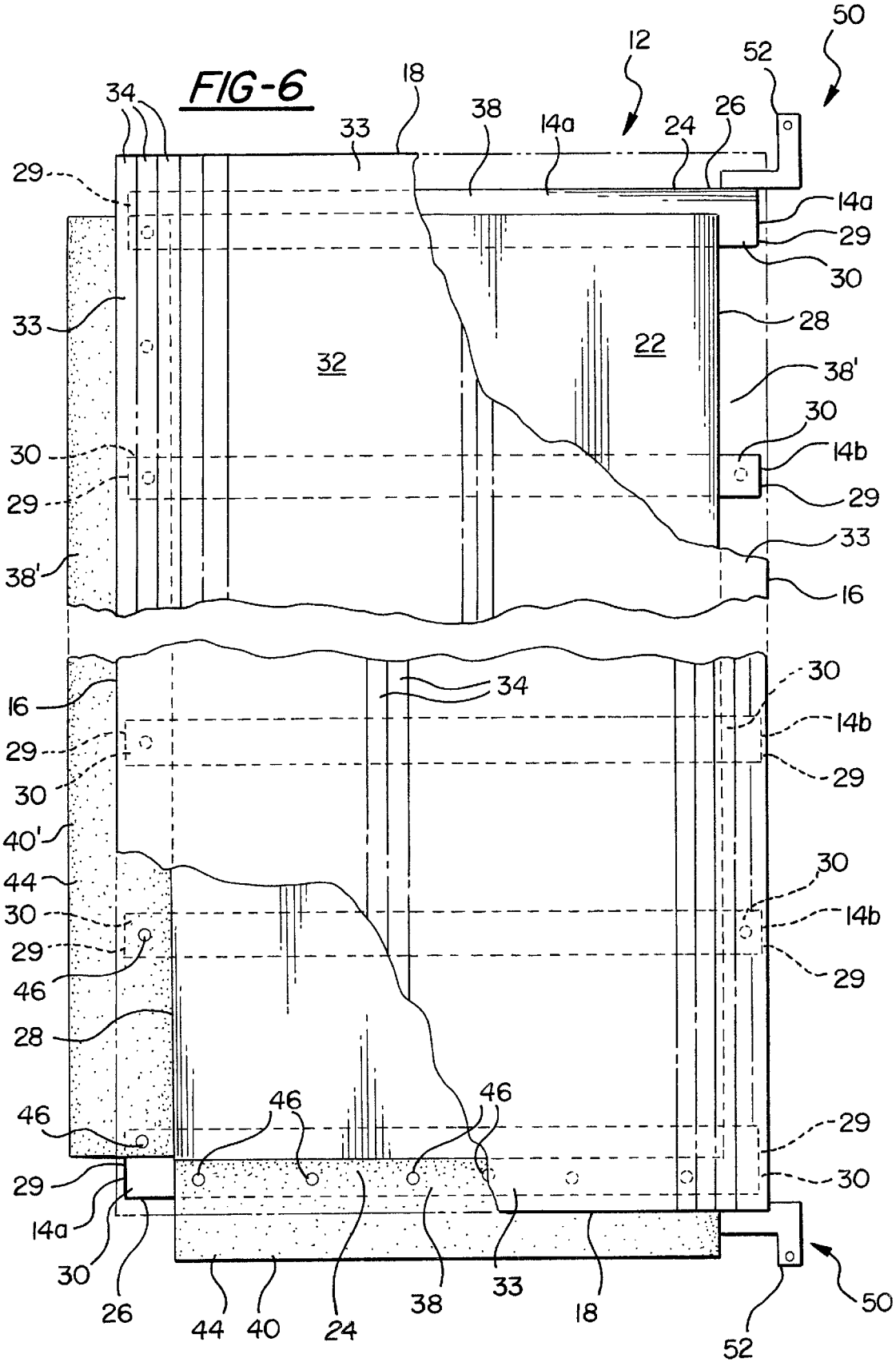
FIG. 6 is an enlarged, fragmentary top plan view of a floor section, with parts thereof broken away, showing further details of the construction.

As shown best in FIG. 6 and as well in FIGS. 2–5, the upper flooring layer 32 is dimensioned according to the pre-set standards (i.e., four by four or four by eight foot sections) and is applied to the subfloor 22 such that one or more marginal regions 33 of the flooring layer 32 project beyond one or more of the recessed edges 24, 28 of the subfloor 22. In the case of the intermediate floor section illustrated in FIG. 6, the flooring layer 32 projects beyond all four edges of the subfloor 22, presenting an exposed underside or bottom surface 36 overhang of the flooring layer 32 that is spaced by the thickness of the subfloor 22 from the opposing top surfaces 30 of the underlying sleepers 14. It will thus be seen from FIGS. 2–4 that recessing the subfloor 22 inwardly from the marginal edges of the sleepers 14 and flooring layer 32 has the effect of defining integrated grooves or edge pockets 38, 38' between the top surface 30 of the sleepers and the bottom surface 36 of the flooring layer 32 along the adjoining end and side edges 18, 16, respectively, of the floor sections 12, having a depth defined by the recessed end or side edge 24, 28 of the subfloor 22.

Figure 3:
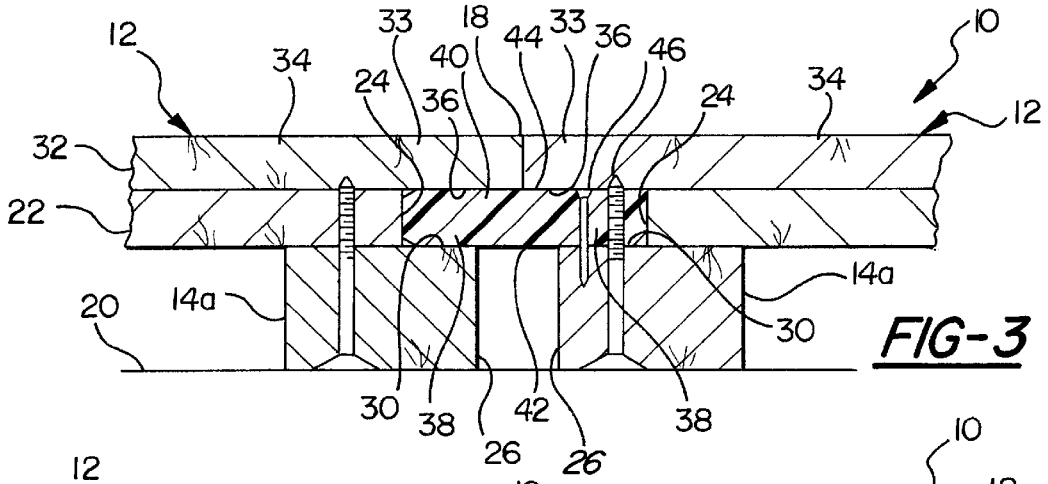
FIG. 3 is an enlarged, fragmentary cross-sectional view taken generally along lines 3—3 of FIG. 1.
Figure 4:
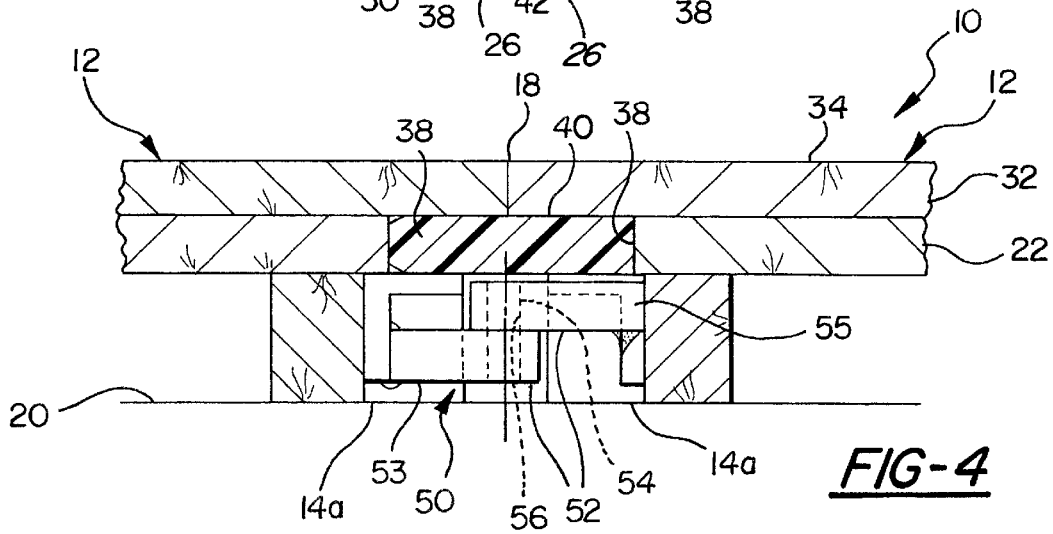
FIG. 4 is an enlarged, fragmentary cross-sectional view taken along lines 4—4 of FIG. 1.
Figure 5:
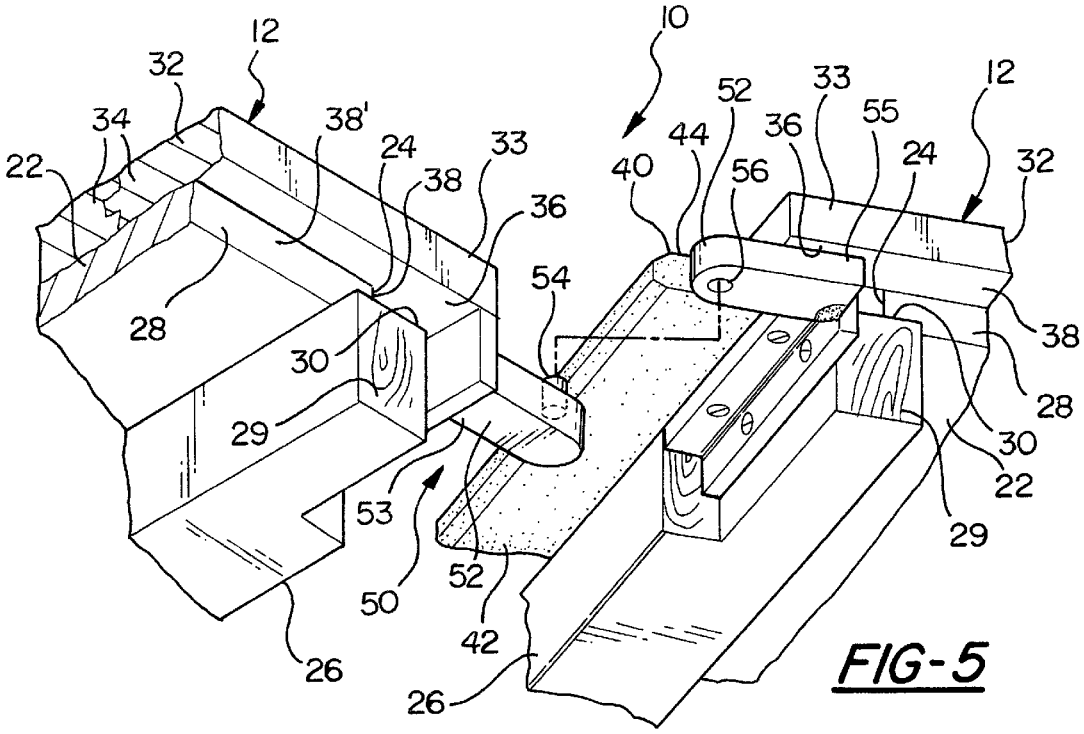
FIG. 5 is an enlarged, fragmentary bottom perspective view showing details of the connecting hardware and edge constructions of adjacent floor panels.

As illustrated in FIGS. 3 and 6, the end-most sleepers 14*a* are relatively greater in width than those of the intermediate sleepers 14*b* to enhance the exposed top surface area 30 of the sleepers 14 along one or both ends 18 of the floor sections 12. In the preferred construction, the intermediate sleepers 14*b* are typically two inch by two inch (nominal) wood strips, whereas the end-most sleepers 14*a* are preferably two inch by three inch (nominal) wood strips laid on their sides so that the three inch dimension extends lengthwise of the section 12. It will be appreciated, however, that wider or narrower sleepers could be used, provided sufficient area is provided to the exposed top surface 30.

As also shown best in FIG. 6, the end-most sleepers 14*a* provide a continuous, uninterrupted bottom wall to the edge pockets 38 along the end edges 18 of the floor section 12, whereas the edge pockets 38' along the side edges 16 of the floor sections 12 are defined in part by the spaced apart end regions 26 of the sleepers 14.

Each floor section 12 is further provided with at least one and in the case of the intermediate floor sections, preferably two tongue members 40, 40' that are disposed in the corresponding edge pockets 38, 38' of the floor sections 12, respectively. As shown best in FIG. 6, the tongue members 40, 40' are disposed in the edge pockets 38, 38' of adjacent side 16 and end 18 edges of the floor sections 12, with the edge pockets 38, 38' of the two remaining side and end edges being open and unoccupied.

The tongue members 40, 40' are preferably the same thickness as the subfloor material 22, such that bottom surfaces 42 of the tongue members 40, 40' engage and are supported on the top surfaces 30 of the sleepers 14. Top surfaces 44 of the tongue members 40, 40' engage and support the bottom surface 36 of the overhung flooring layer 32.

The tongue members 40, 40' are secured within the end edge pocket 38 of the floor section 12 on which they are mounted by suitable fasteners, such as nails 46, screws, or adhesives. It will be appreciated from FIGS. 2 and 3 that the tongue members 40, 40' are advantageously installed in the edge pockets 38, 38' during construction of the floor sections 12 prior to securing the overlying flooring layer 32 to the subfloor 22. In practice, after the subfloor 22 has been secured to the sleepers 14, the tongue members 40, 40' can be laid and secured in place on the sleepers 14 after which the flooring layer 32 can be installed in place to partially cover the tongue members 40, 40'. When installed, the tongue members 40, 40' extend outwardly in prolongation of the subfloor 22 presenting an extended portion 44 that projects beyond the associated side or end edge 16, 18 of the floor section 12.

It is preferred that the tongue members 40, 40' be fabricated of elongated strips of organic polymeric material, and more preferably ultra-high molecular weight plastic. The preferred material is fairly rigid, tough, durable, and non-marring. The material will accept the nails 46 or fasteners that secure the tongue members 40, 40' to the sleepers 14. The preferred sleeper material exhibits properties that enable the floor sections 12 to be repeatedly assembled and disassembled without suscepting the floor sections to undue risk of damage. The tongue members 40, 40' are able to absorb an impact force without breaking. Of course, other materials exhibiting the same or similar properties could be used as the tongue members 40, 40' without departing from the scope of the invention.

Figure 2:
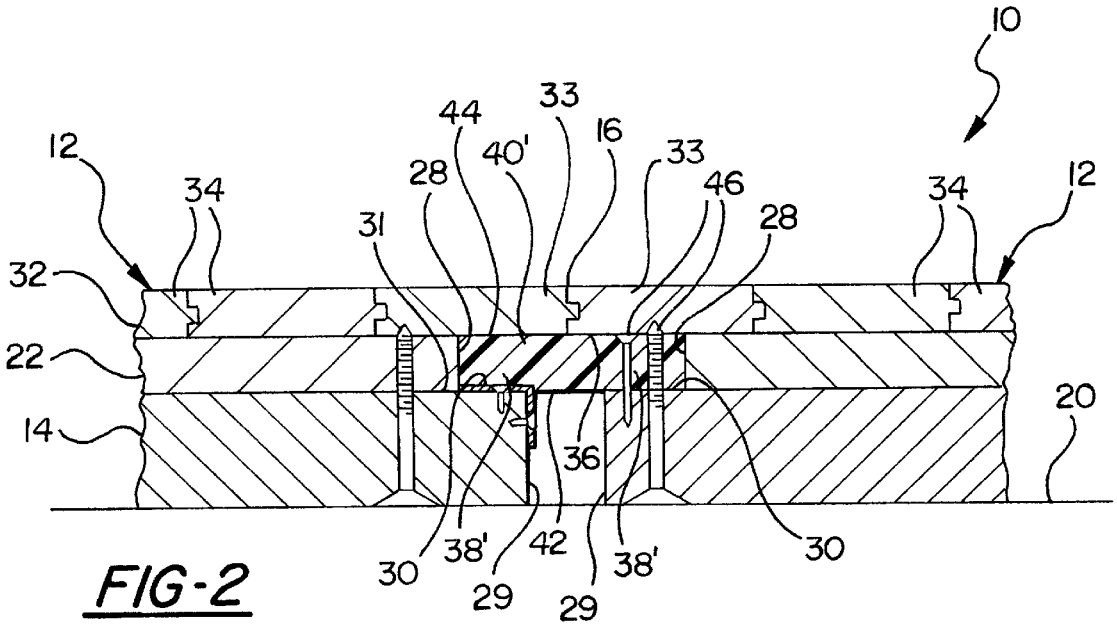
FIG. 2 is an enlarged, fragmentary cross-sectional view taken along lines 2—2 of FIG. 1.

As shown in FIG. 2, the exposed end of the sleeper 14 into which the tongue member 40, 40' is pivoted may include a sheath 31 thereon. Preferably, the sheath 31 is placed on the top surface with one end wedged between the sleeper 14 and subfloor 22 to retain the end. The sheath 31 extends over the end at the sleeper and is bent down in an L-shape. The sheath 31 is preferably tacked into place using suitable fasteners. At least one fastener is provided at the outboard end of the sleeper 14 to keep the sheath 31 in place. A second fastener may also be used on the top surface of the sleeper 14 to keep the sheath 31 in place. The sheath 31 helps prevent undue wear on the sleeper 14 from the repeated insertion and removal of the tongue member 40' from the pocket 38'. The sheath preferably comprises a thin piece of metal that is wear resistant. Twenty-two to twenty-four gauge tin has been found to be acceptable for the sheath 31.

Similarly, a sheath may be used on the end edge sleepers 14*a*. The sheath 31 is attached in a similar manner, except that the sheath 31 extends the entire length of the sleeper 14*a*.

The floor sections 12 are also fitted with suitable connecting hardware generally shown at 50 that secures the sections together. The connecting hardware 50 preferably includes pivot bracket sets 52 which are provided at abutting corners of adjoining floor sections 12, as illustrated schematically in FIG. 1 and in more detail in FIGS. 4 and 5. The first row of floor sections 12 shown at the left of FIG. 1 may have their bracket sets 52 disposed at their outboard corners. The remainder of the bracket sets 52 in subsequent rows are preferably located on the opposite inboard corners.

One of the brackets 53 of the set 52 carries a pivot pin 54 that projects vertically upwardly for accommodation within a corresponding bore 56 of the corresponding bracket 55 to establish a secure but separable pivot connection between adjacent panels.

The flooring system 10 is assembled by laying the first row of perimeter sections and then attaching individual sections to build subsequent rows. A given section 12 in a row is installed by laying it flat on the base surface 20 and coupling its corner bracket 55 with the corresponding corner bracket 53 of the previously laid section in that row. The section 12 is then rotated about the axis of the pivot pin 54 toward the previously laid row, bringing the hinged end 18 of the section into abutting end-to-end engagement with the corresponding hinged end of the previously laid section of that row, and bringing the leading side edge 16 of the section 12 into abutting engagement with the facing side edges of two floor sections of the previously laid row.

Side brackets 58 are provided on the sections 12 for securing the abutting sides of the sections 12 to one another, preventing them from moving laterally relative to one another. The side brackets 58 may be of the type disclosed in the commonly owned U.S. Pat. No. 4,538,392, the disclosure of which is incorporated herein by reference.

As the sections 12 are brought together, the extended portions 48 of the tongues 40, 40' are received into and supported by the opposing edge pockets 38, 38' of the adjacent floor sections 12. The full vertical contact between the flooring layers 32, the tongues 40, 40', and the underlying sleepers 14 of the sections 12 restrains the sections 12 from relative vertical movement either up or down at the joints. In this way, the support to the flooring layer 32 is continuous across the end and side joints giving the flooring surface a firm, uniform playability characteristic across the entire flooring surface.

This type arrangement can be used for both floor panels having either square ends and those with extending boards in a finger-like arrangement.

FIGS. 7 and 8 show alternative embodiment of the invention, and particularly of alternative joint support configurations, wherein like reference numerals indicate like parts, but are offset by 100. As illustrated, adjacent floor sections 112 are fabricated of the same three layer construction, including a plurality of spaced apart sleepers or stringers 114, a subfloor 122 secured to the stringers, and a wood strip flooring layer 132 secured to the subfloor 122.

An edge groove or pocket 138 is formed along at least one mating marginal edge 133 of the flooring layer, and a corresponding edge pocket 138 is formed along the mating edge 133 of the adjacent section. A tongue member 140 is fixedly mounted in one of the edge pockets 138 in position to be received in the edge pocket of the other floor section when the two are abutted, as illustrated in FIG. 8. The tongue member 140 is preferably fabricated of a strip of polymeric material, and preferably ultra-high molecular weight plastic. Alternatively, the tongue member 140 may be made of wood. The tongue member 140 and pocket or grove 138 thus provide a tongue and groove connection between the ends of adjacent floor panels. This arrangement is particularly useful for square end type floor panels.

As shown in FIG. 8, additional joint reinforcement between the ends of adjacent panels may be provided by a generally L-shaped bracket 60 secured to a bottom surface 62 of the subfloor 122 having a leg 64 extending toward the adjacent panel presenting an upper surface 66 that is spaced from the bottom surface 62 of the subfloor 122 to provide an additional edge pocket opening 68 toward the mating edge 118 of the floor section 112.

The adjacent floor section mounts a corresponding additional tongue member 70 that is fixed such as by screws to the bottom surface 62 of the subfloor 122 and projects beyond the subfloor in position for an extended end 72 to be received and supported within the edge pocket 68 of the other floor section, as illustrated in FIG. 8. The tongues 140, 70 and pockets 138, 68 act to restrain the adjoining floor sections 112 against relative vertical flexing at the joints. The bracket 60 and tongue 70 may extend a full length of one or more adjoining edges of the floor sections 112, or they may be arranged intermittently along the edges to provide support to the edge joints as needed. The brackets 60 and tongue members 70 are fabricated of organic polymeric material, and preferably ultra-high molecular weight plastic.

In the alternative embodiment of FIG. 8, the subfloor 22 may be eliminated. In this case, the bracket 60 and tongue member 7 are secured directly to the flooring layer 132. The flooring layer 132 is similarly connected directly to the stringers 114.

It will be appreciated that the tongue and groove joint supports of the invention, for example, those described with respect to FIGS. 1 through 6 and that of FIG. 7, may be used in combinations with one another. For example, the abutting side edges of the panels may be provided with the tongue and groove support system of FIGS. 1 through 6, whereas the abutting ends of the panels may be provided with the tongue and groove support system of FIG. 7.

The disclosed embodiments are representative of a presently preferred forms of the invention, but are intended to be illustrative rather than definitive thereof.

Obviously, many modifications and variations of the present invention are possible in light of the above teachings. It is, therefore, to be understood that within the scope of the appended claims, the invention may be practiced otherwise than as specifically described.

What is claimed is:

1. A portable multi-section activity flooring system comprising:

a plurality of floor sections adapted to be assembled with one another on a generally planar base surface along abutting end and side edges thereof to provide a continuous planar activity surface;

each floor section including a plurality of spaced apart sleepers engageable with the base surface on which said flooring system is to be installed, a subfloor secured to said sleepers, and a flooring layer secured to said subfloor;

at least a pair of said floor sections including at least one edge pocket provided on at least one of said sections of said pair along at least one of its said abutting edges thereof, said edge pocket defined by the flooring layer and at least one underlying sleeper of said section; and at least the other of said pair of said floor sections including an edge pocket formed between said flooring layer and at least one underlying sleeper thereof along said at least one abutting edge and at least one corresponding tongue member provided along at least one of its said abutting edges and secured within said edge pocket of said other floor section and extending outwardly therefrom in position to be received within said edge pocket of said one floor section when said pair of sections are assembled such that said tongue member is supported between said flooring layer and at least one underlying sleeper of said other floor section.

2. The flooring system of claim 1 wherein said tongue member is fabricated of polymeric material.

3. The flooring system of claim 2 wherein said polymeric material comprises ultra-high molecular weight plastic.

4. The flooring system of claim 1 wherein said tongue member and said edge pockets extend substantially the full width of said abutting edges of said pair of floor sections.

5. The flooring system of claim 1 wherein said abutting edges comprise opposed marginal end edges of said respective flooring layers of said pair of floor sections, said tongue member being secured between said marginal end edge of said flooring layer and a marginal longitudinal side edge of an end-most one of said sleepers.

6. The flooring system of claim 1 wherein said abutting edges comprise opposed marginal side edges of said respective flooring layers of said pair of floor sections, said tongue member being secured between said marginal side edge of said flooring layer and spaced end portions of a plurality of said sleepers.

7. The flooring system of claim 1 wherein said pair of floor sections includes said edge pockets and said tongue member along at least one adjacent end and one side edge thereof for connecting said floor sections to one another and to corresponding adjacent ones of said floor sections.

8. The flooring system of claim 1 wherein said edge pockets are defined by a recessed portion of said subfloors spaced inwardly of an outer edge of said flooring layer and an outer edge of said underlying sleeper, said outer edge of said underlying sleeper extending laterally outward no further than the outer edge of the flooring layer.

9. The flooring system of claim 1 wherein said tongue member includes a top surface engaging and supporting said bottom surfaces of said flooring layers of said floor sections, and a bottom surface of said tongue member engaging and supported by said top surface of said sleepers of said floor sections.

10. The flooring system of claim 9 wherein said tongue member is fabricated of polymeric material.

11. The flooring system of claim 10 wherein said polymeric material comprises ultra-high molecular weight plastic.

12. The flooring system of claim 9 wherein said edge pocket isk provided along at least one of said end edges of said one floor section.

13. The flooring system of claim 11 wherein said at least one of said end edges is squared.

14. The flooring system of claim 9 wherein said edge pocket is provided along at least one of said side edges of said one floor section.

15. The flooring system of claim 9 wherein said edge pocket is provided along at least one of said end edges of said one floor section and along at least one of said side edges of said one floor section.

16. The flooring system of claim 15 wherein said plurality of said sleepers of said floor sections includes a pair of end-most sleepers extending lengthwise along said end edges of said floor sections and at least one intermediate sleeper disposed between said end-most sleepers.

17. The flooring system of claim 16 wherein said intermediate sleeper has a predetermined width and said end-most sleepers have predetermined widths greater than that of said intermediate sleeper.

18. The flooring system of claim 16 including connecting hardware provided on said floor sections and operative to secure said floor sections releasably to one another when assembled.

19. A portable multi-section activity flooring system comprising:

a plurality of floor sections adapted to be assembled with one another on a generally planar base surface along abutting peripheral end and side edges thereof to provide a continuous planar activity surface;

each floor section including a plurality of spaced apart sleepers engageable with the base surface on which said flooring system is to be installed, a subfloor secured to said sleepers, and a flooring layer secured to said subfloor;

a tongue member supported by at least one floor section along at least one of said peripheral abutting edges thereof between said flooring layer and at least one underlying sleeper thereof, said one floor section further including an edge pocket formed between a bottom surface of said flooring layer and a top surface of at least one underlying sleeper thereof, said tongue member being mounted within said edge pocket of said one floor section and having an extended portion projecting beyond said peripheral abutting edge; and an edge pocket provided on an adjacent one of said floor sections along at least one of said peripheral abutting edges thereof, said edge pocket defined by a recessed portion of said subfloor spaced inwardly of an outer edge of said flooring layer and an outer edge of at least one underlying sleeper thereby exposing a bottom surface of said flooring layer and a top surface of said at least one sleeper, said edge pocket being in position to receive and support said extended portion of said tongue member when said floor sections are assembled.

20. A method of constructing and installing floor sections of a portable multi-section activity flooring system to provide a continuous activity surface, said method comprising the steps of:

constructing at least one floor section of the flooring system by a) arranging a plurality of sleepers in spaced relationship to one another, b) securing a subfloor to the sleepers with at least one marginal end edge of the subfloor being recessed inwardly of and generally parallel to a marginal longitudinal side edge of an endmost one of the underlying sleepers to expose a top surface along the length of the endmost sleeper, and c) securing a flooring layer to the subfloor with at least one corresponding marginal end edge thereof projecting beyond the recessed end edge of the subfloor to provide an end edge pocket between a bottom surface of the flooring layer and the top surface of the endmost sleeper;

constructing at least one adjacent floor section of the flooring system according to the same method of constructing said one floor section, and including the step of securing a tongue member within the end edge pocket of the adjacent floor section having an extended portion thereof projecting beyond the marginal end edge of the adjacent floor section in a position to be received into the end edge pocket of the one floor section;

laying the floor sections on a generally planar base surface; and bringing the respective marginal end edges of the floor sections into abutting engagement with one another so as to extend the tongue of the adjacent floor section into the end edge pocket of the one floor section such that the tongue member engages and is supported by the endmost sleeper within the end edge pocket of the one floor section and a top surface of the tongue member engages and supports the bottom surface of the flooring layer of the one floor section.

21. The method of claim 20 including constructing additional floor sections having said edge pockets and said tongue members and assembling them with said floor sections and one another to provide a continuous activity surface.

22. The method of claim 21 including providing said edge pockets and said tongue members along all abutting side and end edges of the assembled panel sections.

23. The method of claim 20 including fabricating the tongue member of ultra-high molecular weight plastic.

24. The method of claim 20 including securing the tongue member within the end edge pocket of the adjacent floor section by fastening the tongue member to the top surface of at least one endmost sleeper prior to securing the flooring layer to the subfloor.

25. A portable multi-section activity flooring system comprising:

a plurality of floor sections adapted to be assembled with one another on a generally planar base surface along abutting end and side edges thereof to provide a continuous planar activity surface;

each floor section including a plurality of spaced apart sleepers engageable with the base surface on which said flooring system is to be installed, a subfloor secured to said sleepers, and a flooring layer secured to said subfloor with at least one marginal end edge of the flooring layer disposed over and paralleling an endmost one of said sleepers;

at least a pair of said floor sections including at least one edge pocket provided on at least one of said sections of said pair along at least one of its said abutting marginal end edges thereof, said edge pocket defined by the flooring layer and at least one underlying endmost sleeper of said section; and at least the other of said pair of said floor sections including at least one corresponding tongue member provided along at least one of its said abutting end edges in a position to be received within said edge pocket of said one floor section when said pair of sections are assembled such that said tongue member is supported between said marginal end edge of said flooring layer and a marginal longitudinal side edge of at least one of said underlying endmost sleepers of said other floor section.

26. A portable multi-section activity flooring system comprising:

a plurality of floor sections adapted to be assembled with one another on a generally planar base surface along abutting end and side edges thereof to provide a continuous planar activity surface;

each floor section including a plurality of spaced apart sleepers engageable with the base surface on which said flooring system is to be installed, a subfloor secured to said sleepers, and a flooring layer secured to said subfloor;

at least a pair of said floor sections including at least one edge pocket provided on at least one of said sections of said pair along at least one of its said abutting edges thereof, said edge pocket defined by the flooring layer and at least one underlying sleeper of said section;

at least the other of said pair of said floor sections at least one corresponding tongue member provided along at least one of its said abutting edges in position to be received within said edge pocket of said one floor section when said pair of sections are assembled such that said tongue member is supported between said flooring layer and at least one underlying sleeper of said other floor section; and wherein said abutting edges comprise opposed marginal end edges of said respective flooring layers of said pair of floor sections, said tongue member being secured between said marginal end edge of said flooring layer and a marginal longitudinal side edge of an end-most one of said sleepers.

27. A portable multi-section activity flooring system comprising:

a plurality of floor sections adapted to be assembled with one another on a generally planar base surface along abutting end and side edges thereof to provide a continuous planar activity surface;

each floor section including a plurality of spaced apart sleepers engageable with the base surface on which said flooring system is to be installed, a subfloor secured to said sleepers, and a flooring layer secured to said subfloor;

at least a pair of said floor sections including at least one edge pocket provided on at least one of said sections of said pair along at least one of its said abutting edges thereof, said edge pocket defined by the flooring layer and at least one underlying sleeper of said section;

at least the other of said pair of said floor sections including at least one corresponding tongue member provided along at least one of its said abutting edges in position to be received within said edge pocket of said one floor section when said pair of sections are assembled such that said tongue member is supported between said flooring layer and at least one underlying sleeper of said other floor section, said at least one underlying sleeper protruding laterally outward no further than a peripheral outer edge of said flooring layer; and wherein said pair of floor sections includes said edge pockets and said tongue member along at least one adjacent end and one side edge thereof for connecting said floor sections to one another and to corresponding adjacent ones of said floor sections.

* * * * *